US005177314A

United States Patent [19]

Matsuda et al.

[11] Patent Number: 5,177,314

[45] Date of Patent: * Jan. 5, 1993

[54] TIMBRE SETTING DEVICE FOR AN ELECTRONIC MUSICAL INSTRUMENT

[75] Inventors: Takashi Matsuda, Oome; Tatsuya Iijima, Fussa, both of Japan

[73] Assignee: Casio Computer Co., Ltd., Tokyo, Japan

[ * ] Notice: The portion of the term of this patent subsequent to Sep. 3, 2008 has been disclaimed.

[21] Appl. No.: 716,129

[22] Filed: Jun. 17, 1991

Related U.S. Application Data

[62] Division of Ser. No. 332,802, Apr. 3, 1989, Pat. No. 5,044,251.

[30] Foreign Application Priority Data

Apr. 11, 1988 [JP] Japan ..... 63-87361
Dec. 5, 1988 [JP] Japan ..... 63-307566

[51] Int. Cl.[5] ..... G10H 1/057; G10H 1/06; G10H 1/46

[52] U.S. Cl. ..... 84/615; 84/622; 84/627; 84/633

[58] Field of Search ..... 84/603-607, 84/615, 622-625, 627, 633

[56] References Cited

U.S. PATENT DOCUMENTS 4,138,915 2/1979 Nagai et al. .
4,387,617 6/1983 Kato et al. .
4,502,359 3/1985 Sano .
4,566,364 1/1986 Katoh .
4,590,838 5/1986 Kashio .
4,612,838 9/1986 Nagashima et al. .
4,890,527 1/1990 Suzuki et al. .
4,893,538 1/1990 Masaki et al. ..... 84/622 X

FOREIGN PATENT DOCUMENTS 52-107823 9/1977 Japan .
53-83730 7/1978 Japan .
54-50314 4/1979 Japan .
61-18756 5/1986 Japan .
62-52316 11/1987 Japan .

*Primary Examiner*—Stanley J. Witkowski
*Attorney, Agent, or Firm*—Frishauf, Holtz, Goodman & Woodward

[57] ABSTRACT

An electronic musical instrument can execute a musical performance with two timbres mixed together by operating a single key, for example. Of the two timbres, a master timbre is set in normal mode and is stored in a first memory, while a slave timbre is selected in tone mix mode and is stored in a second memory. Each timbre can be altered as desired. To alter the master timbre, timbre switches are operated after the mode is temporarily changed to normal mode. To alter the slave timbre, the timbre switches are operated in tone mix mode. When the tone mix mode is set, this electronic musical instrument can permit a player to easily alter tone parameters such as the volume, pitch and attack delay time of each timbre.

12 Claims, 10 Drawing Sheets

| TIMBRE NAME | TIMBRE No. |
|---|---|
| PIANO | 0 |
| HARPSICHORD | 1 |
| VIBRAPHONE | 2 |
| ORGAN | 3 |
| FLUTE | 4 |
| GUITAR | 5 |
| TRUMPET | 6 |
| OBOE | 7 |
| VIOLIN | 8 |
| HARP | 9 |

FRONT TIMBRE
BACK TIMBRE

| MASTER TIMBRE NO. REGISTER | SLAVE TIMBRE NO. REGISTER | TONE MIX FLAG |
|---|---|---|

FIG. 9

| TIMBRE NAME | TIMBRE NO. |
|---|---|
| PIANO | 0 |
| E.PIANO | 1 |
| P.ORGAN | 2 |
| VIB | 3 |
| HARP. | 4 |
| BRASS | 5 |
| STRINGS | 6 |
| E.GUITAR | 7 |
| E.BASS | 8 |
| FANTASY | 9 |

FIG. 10

TIMBRE SETTING DEVICE FOR AN ELECTRONIC MUSICAL INSTRUMENT

This is a division of application Ser. No. 07/332,802, filed Apr. 3, 1989, now U.S. Pat. No. 5,044,251.

BACKGROUND OF THE INVENTION

1. Field of the Invention

The present invention relates to an electronic musical instrument, and, more particularly, to an electronic musical instrument which simultaneously generates musical tones with two types of timbres by a single input operation for a musical performance.

2. Description of the Related Art

Conventional synthesizer type electronic musical instruments operate in various modes that include a tone mix mode which permits simultaneous generation of tone signals with two timbres at the same pitch by a single musical input operation. To play music in this tone mix mode, a tone mix switch on an operation panel must first be activated. Then, a display section displays characters which indicate the tone mix mode being selected as well as those characters which indicate various parameters for each of the first and second musical tones, such as the volume, timbre, pitch and chorus effect. A player operates a cursor key to move a cursor through the display of these parameters to the position where the volume parameter for the first musical tone is displayed, and sets a value key to set the proper volume level. The player then operates a memory bank key and a memory number key to select a desired timbre from among those timbres set in advance in the synthesizer, sets the desired timbre as the timbre for the first musical tone, and operates the cursor and value keys to adjust the pitch of the first musical tone. Subsequently, the player similarly operates the cursor key, value key, memory bank key, memory number key, etc. to set the volume, timbre, pitch, etc. of the second musical tone. Accordingly, the player needs to repeatedly operate these keys in addition to operating the tone mix switch, and thus needs time and labor to set the parameters of two types of musical tones for musical performance in tone mix mode.

According to keyboard type conventional electronic musical instruments, timbre switches associated with different types of timbres for selecting and setting the first timbre (master timbre), timbre switches associated with different types of timbres for selecting/setting the second timbre (slave timbre) and a switch to designate the first or second timbre are provided on a panel. It is difficult as well as costly to provide so many timbre switches, etc. on the panel within a limited space.

SUMMARY OF THE INVENTION

Accordingly, it is an object of this invention to provide an electronic musical instrument which ensures musical performance with a timbre attained by mixing two types of timbres through a simple timbre setting operation.

It is another object of this invention to provide an electronic musical instrument in which a timbre designating means sequentially designates a plurality of timbre data, and inputs them into at least one of a first and second memory means.

According to a first aspect of the present invention, a timbre setting device for an electronic musical instrument, for setting a tone signal of a first-and-second-timbre mixed type, comprises timbre designating means for sequentially designating a plurality of timbre data; fist memory means for storing timbre data of said first timbre; second memory means for storing timbre data of said second timbre: and timbre setting control means for causing at least one of said first memory means and said second memory means to store the last of said plurality of timbre data designated by said timbre designating means.

According to another aspect of the invention, an electronic musical instrument for generating a tone signal with a first timbre in a normal mode, and a tone signal with first timbre and a second timbre in a tone mix mode, comprises mode selecting means for selectively setting one of said normal mode and said tone mix mode; timbre designating means for sequentially designating a plurality of timbre data; first memory means for storing first timbre data of said first timbre; second memory means for storing second timbre data of said second timbre; timbre setting control means for causing at least one of said first memory means and said second memory means to store the last of said plurality of timbre data designated by said timbre designating means; and tone signal generating means for generating a tone signal according to the first timbre data in said first memory means when said normal mode is set by said mode selecting means and for generating a tone signal according to both said first timbre data in said first memory means and said second timbre data in said second memory means when said tone mix mode is set by said mode selecting means.

BRIEF DESCRIPTION OF THE DRAWINGS

FIGS. 8 through 14 are for explaining the second embodiment of this invention as applied to an electronic keyboard instrument. In these figures:

FIG. 1 is a general circuit diagram of the first embodiment;

FIG. 2 is a diagram for explaining a select key, timbre key and tone bank key for setting timbres;

FIG. 3 is a diagram for explaining a timbre control register;

FIG. 4 is a diagram illustrating the correlation between timbre numbers and timbre names;

FIG. 5 is a general flowchart of a CPU;

FIG. 6 is a flowchart illustrating a display process of a function display section;

FIG. 7 is a flowchart for a timbre setting process;

FIG. 8 is a diagram for explaining the operation of a timbre select key, tone mix key, etc.;

FIG. 9 is a diagram for explaining a timbre control register;

FIG. 10 is a diagram illustrating the correlation between timbre numbers and timbre names;

FIG. 11 is a general flowchart of a CPU;

FIG. 12 is a flowchart illustrating a display process of a function display section;

FIG. 13 is a flowchart for a timbre setting process; and

FIG. 14 is a flowchart for a process for variably setting parameters of a musical tone with a slave timbre in tone mix mode.

DETAILED DESCRIPTION OF THE PREFERRED EMBODIMENTS

First Embodiment

Arrangement

Figure 1:
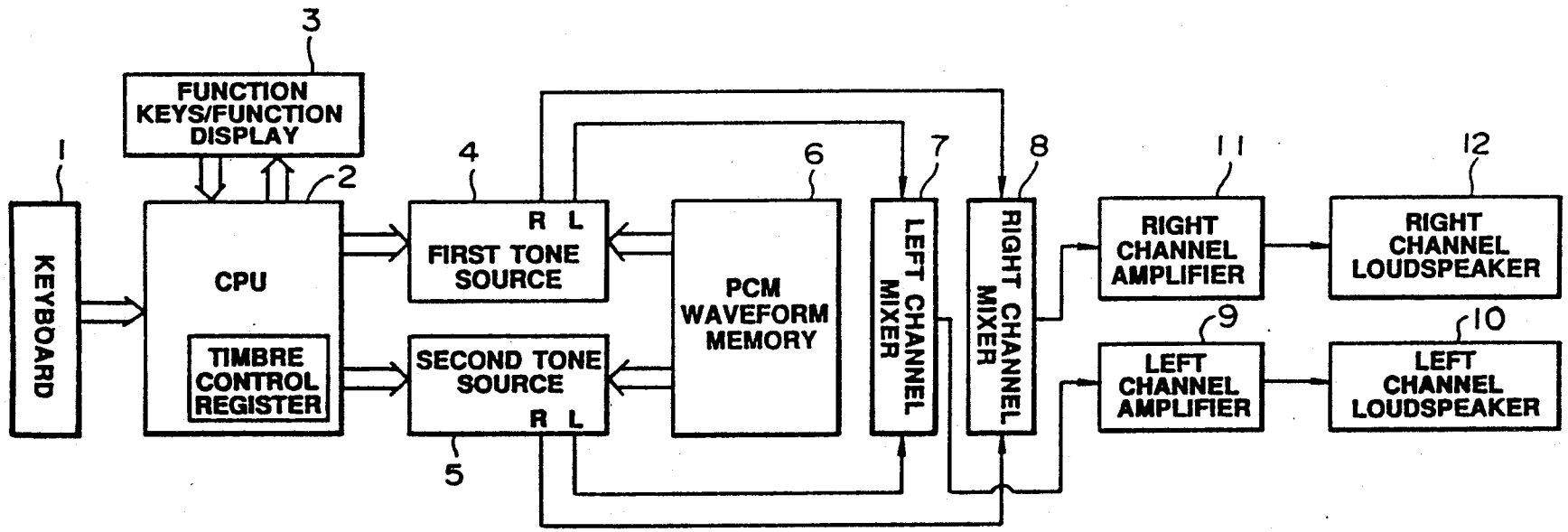
FIGS. 1 through 7 are for explaining the first embodiment of this invention as applied to an electronic keyboard instrument.

The first preferred embodiment of this invention will be described below. FIG. 1 is a general circuit diagram of an electronic musical instrument according to the first embodiment. Keyboard 1 is a play input detecting means which sends control data about tone generation/-stopping and a tone pitch to a CPU (central processing unit) 2 in a microcomputer when a player performs a musical operation: key depression or key release. A function keys/function display section 3 includes function keys operable for selecting or setting a musical tone, a timbre or the and a display for indicating the operational status of the function keys, and it exchanges control signals with the CPU 2. A first sound source 4 and a second sound source 5 are of the same type; when requested by the CPU 2 to generate musical tones, these sound sources 4 and 5 read out PCM waveforms for timbres corresponding to the operation of the function keys from a PCM waveform memory 6 and prepare musical tones. This memory 6 includes a ROM in which a plurality of signal waveforms of musical tones are stored in advance in PCM mode. The first and second sound sources 4 and 5 each generate a tone signal for a left channel (L) and a tone signal for a right channel (R) for stereo sound and send them to a left channel mixer 7 and a right channel mixer 8. The tone signals for the left channel are mixed in the former mixer 7, and the tone signals for the right channel in the latter mixer 8. The mixed tone signal from the mixer 7 is generated as a stereo musical tone through a left channel amplifier 9 and a left channel loud-speaker 10, while the mixed tone signal from the mixer 8 is generated as a stereo musical tone through a right channel amplifier 11 and a right channel loudspeaker 12.

Figure 2:
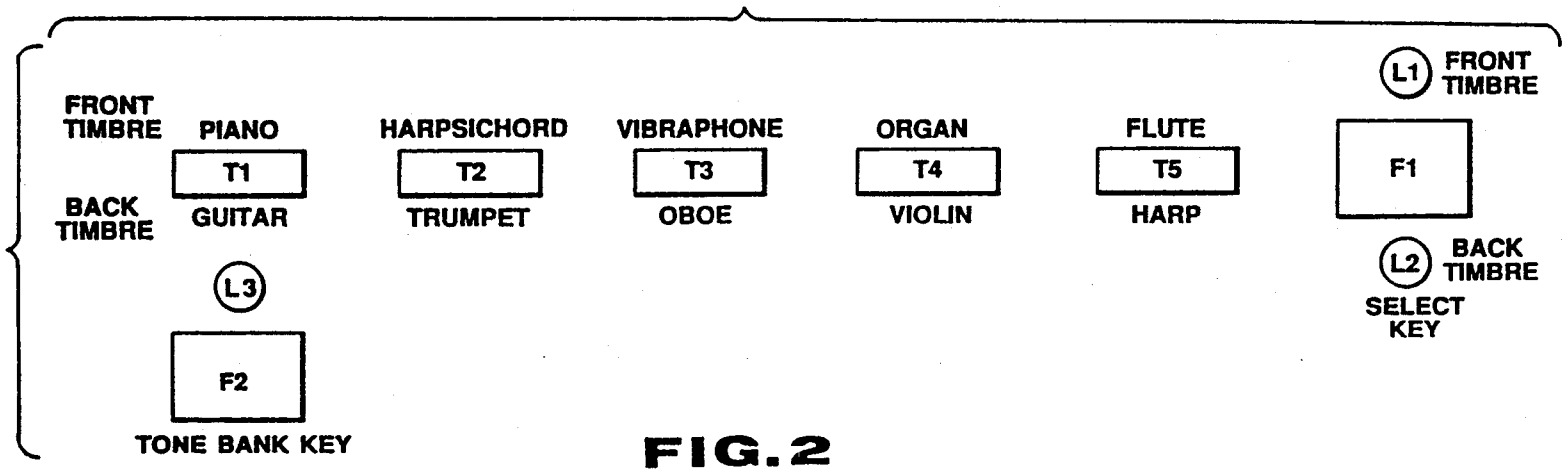

FIG. 2 illustrates the essential section of the function keys/function display section 3 shown in FIG. 1. A function key or select key F1 serves to selectively set one of two types of timbres (hereinafter referred to as front and back timbres) of each of timbre keys T1 to T5. The individual timbre keys T1–T5 are assigned with the following front and back timbres:

T1: piano (front) and guitar (back);
T2: harpsichord (front) and trumpet (back);
T3: vibraphone (front) and oboe (back);
T4: organ (front) and violin (back); and
T5: flute (front) and harp (back).

For instance, when the select key F1 is pushed ON to select the front timbre, an indicator L1 is lit and the timbre keys T1–T5 are then ready to select and set their front timbres. When the select key F1 is pushed ON again under this condition, the back timbres can now be selected and an indicator L2 is lit, setting the timbre keys T1–T5 ready to select and set their back timbres. In short, the select key F1 functions to switch between the front timbres and back timbres.

A tone bank key F2 switches musical tone functions when depressed. More specifically, the tone bank key F2 switches between a normal mode (tone bank function being OFF) in which a musical tone is generated based on the first timbre (hereinafter referred to as a master timbre) set by the select key F1 and timbre keys T1–T5, and a tone mix mode (tone bank function being ON) in which musical tones with two types of timbres, the master timbre set in normal mode and another (second) timbre set in a similar manner (to be described later), are simultaneously generated by a single key operation. When the tone mix mode is set, an indicator L3 is lit.

Figure 4:
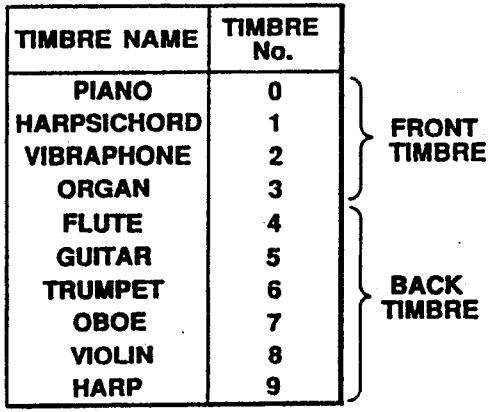
Figure 3:
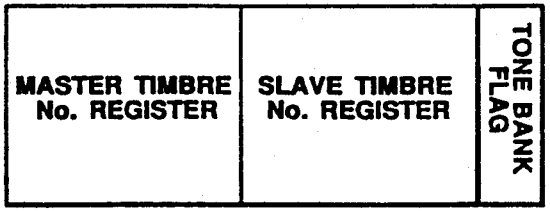

FIG. 3 is a diagram for explaining a timbre control register incorporated in the CPU 2; the register comprises a tone bank flag, a master timbre number register and a slave timbre number register. The tone bank flag is "1" when the tone bank function is set ON or enabled, and it is "0" when this function is set OFF or disabled. When the tone bank function is disabled, the master timbre number register serving as the first memory means stores one of timbre numbers (0 to 9) of the timbres selected by the operation of the select key F1 and timbre keys T1–T5. When the tone bank function is enabled, the slave timbre number register serving as the second memory means stores one of timbre numbers (0 to 9) of the timbres similarly selected. FIG. 4 illustrates the correlation between these timbre numbers and timbre names; timbre numbers 0 to 4 correspond to fine types of front timbres selected by the select key F1, and timbre numbers 5 to 9 correspond to five types of back timbres selected similarly.

Operation

Figure 5:
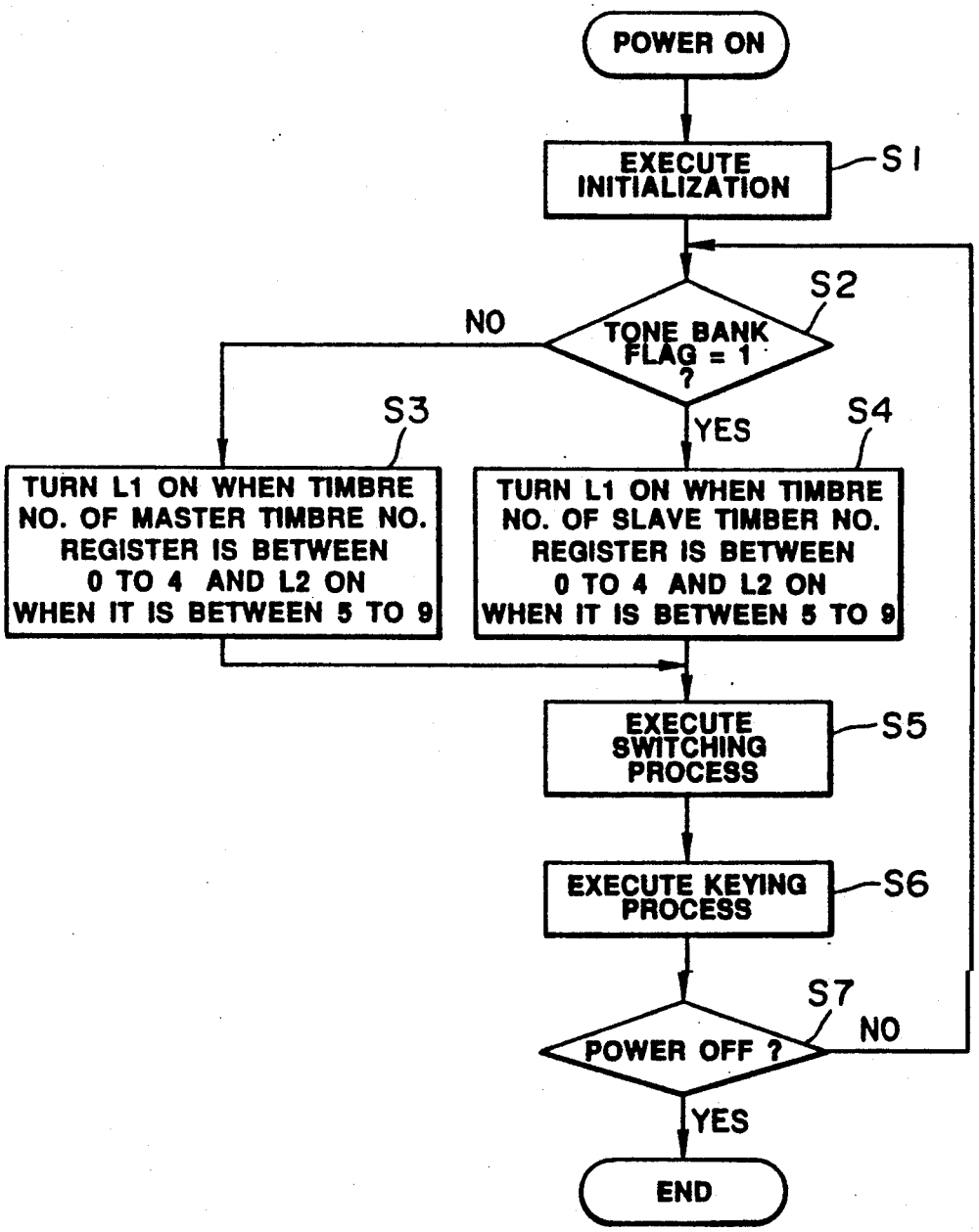

The operation of the first embodiment will now be described. FIG. 5 is a general flowchart for the operation by the CPU 2 which starts when power is supplied to the electronic keyboard instrument according to this embodiment by turning a power switch ON. When the power switch is thrown ON, initialization is executed in which, for example, the select key F1 is set for the front timbre selection, the timbre key T1 is set and the tone bank key F2 is set for the normal mode or tone bank function disabled (step S1). Then, it is discriminated whether or not the tone bank function is set ON or whether or not the tone bank flag is "1" (step S2). In the above initialization, the decision in step S2 is NO, and when the timbre number of the master timbre stored in the master timbre number register is any of 0–4, the indicator L1 is lit to indicate a front timbre being set, and when the stored timbre number is any of 5–9, the indicator L2 is lit to indicate a back timbre being set (step S3). If the decision in step S2 is YES, the indicator L1 is lit to indicate a front timbre being set as a slave timbre when the timbre number of the slave timbre stored in the slave timbre number register is any of 0–4, and the indicator L2 is lit to indicate a back timbre being set as the slave timbre when the stored timbre number is any of 5–9 (step S4). After execution of steps S3 and S4, a switching process (step S5), which will be described later referring to FIGS. 6 and 7, will be executed, followed by a keying process (key ON/OFF) to request tone generation/tone off of the first sound source 4 or second sound source 5 (step S6). It is then discriminated whether or not the power switch is turned OFF (step S7). If the decision here is NO, the flow returns to step S2 and the looped sequence including and following this step is repeated until the power switch is turned OFF. If the decision in step S7 is YES, however, the flow is completed.

Figure 6:
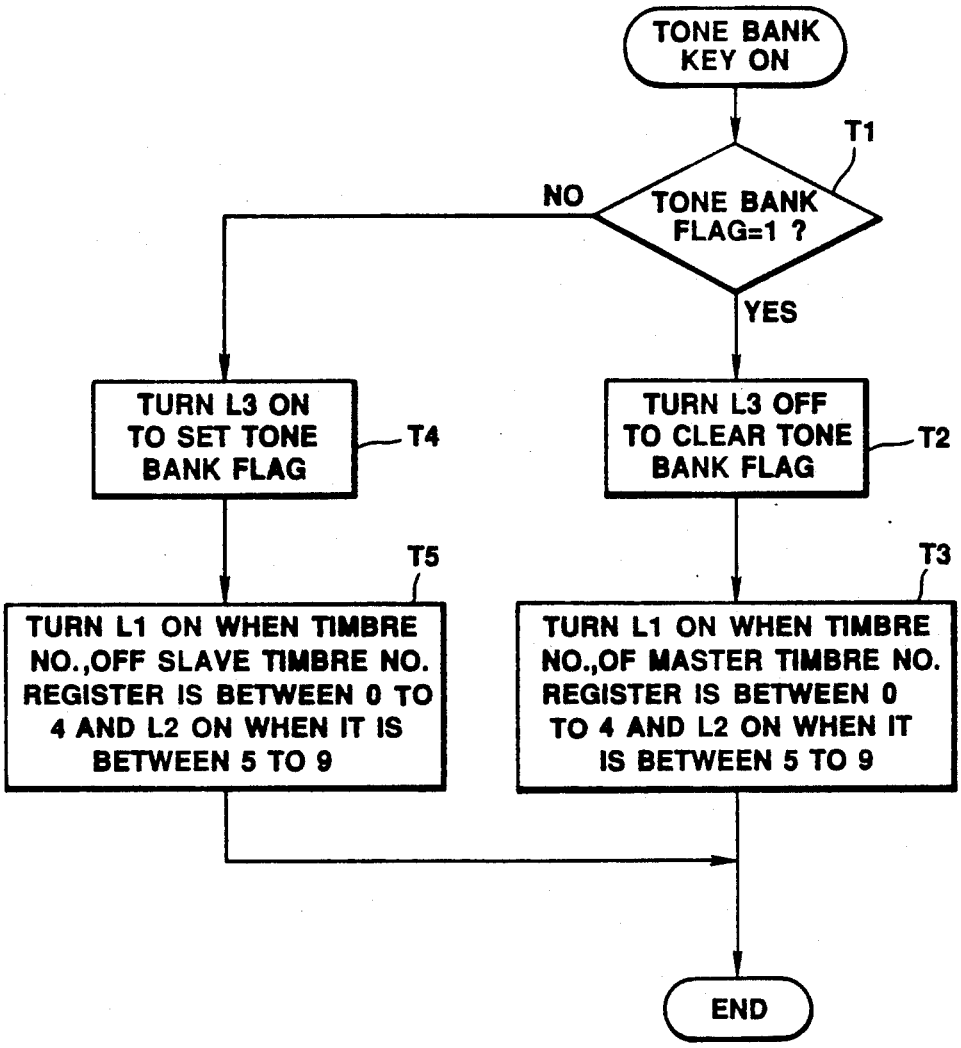

FIG. 6 is a flowchart illustrating the display process of the function display section 3 executed in the switching process (step S5) in the general flow shown in FIG. 5. This process starts when the tone bank key F2 is operated.

First, it is discriminated whether or not "1" is set to the tone bank flag (step T1). If the decision is YES, which means that the tone bank function has already been set ON, the tone bank flag is cleared and the indicator L3 is lit to indicate that the normal mode, not the tone mix mode, is presently set (step T2). When the timbre number stored in the master timbre number register is any of 0–4, the indicator L1 is lit to indicate that one of the front timbres is set as the master timbre by the operation of the select key F1, and when the stored timbre number is any of 5–9, the indicator L2 is lit to indicate a back timbre being set by the select key F1 (step T3), thus completing the flow.

If the decision in step T1 is NO, which means that the tone mix mode is newly set by the tone bank key F2, a new process associated with the setting of the tone mix mode needs to be executed. The CPU 2 sets "1" to the tone bank flag and turns the indicator L3 ON to indicate the tone mix mode being set (step T4). In the subsequent step T5, when the timbre number stored in the slave timbre number register is any of 0–4, the indicator L1 is lit to indicate that one of the front timbres is set as the slave timbre by the operation of the select key F1, and when the stored timbre number is any of 5–9, the indicator L2 is lit to indicate a back timbre being set as the slave timbre, thus completing the flow.

Figure 7:
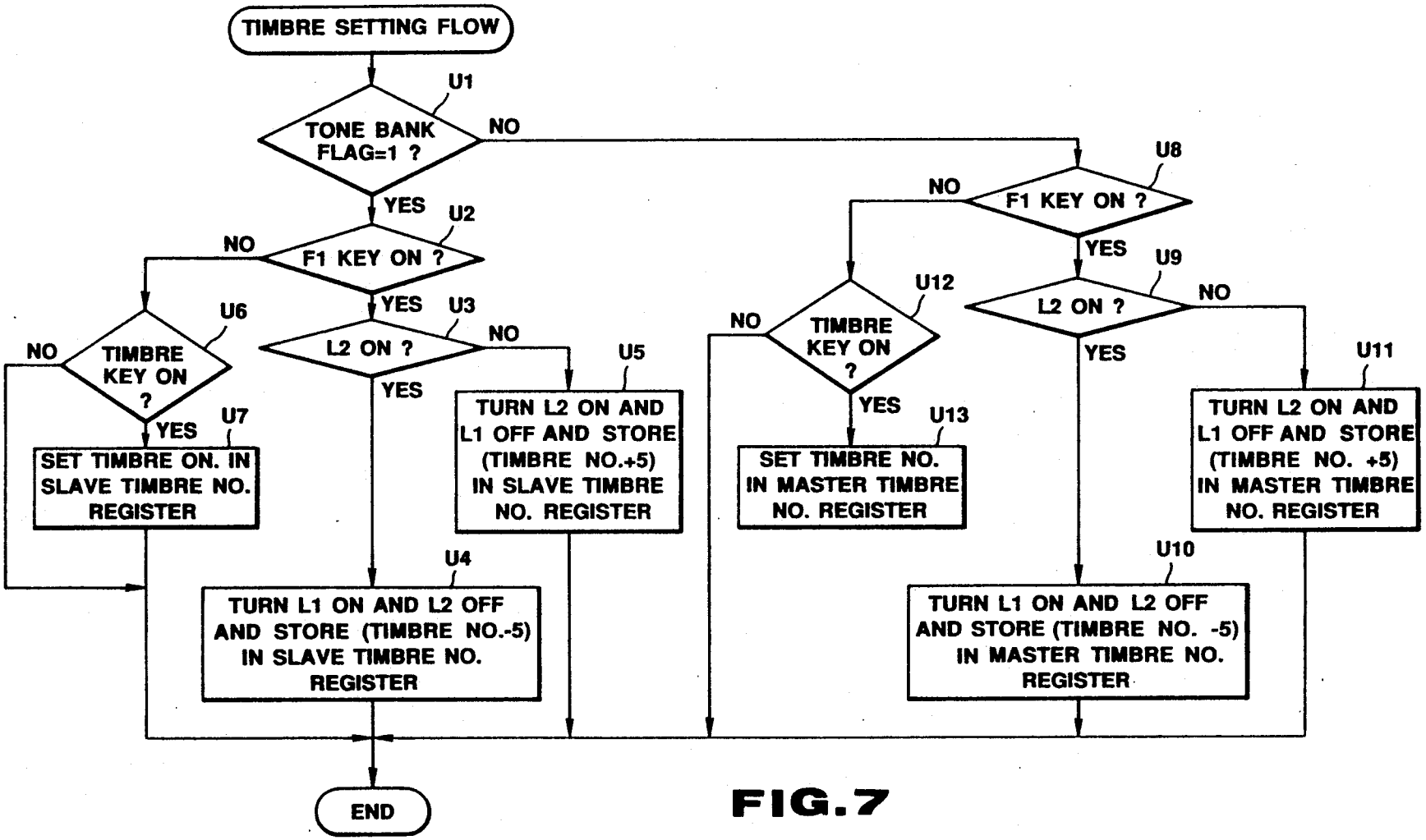

FIG. 7 is a flowchart illustrating a timbre setting process executed in the switching process (step S5) in the general flow shown in FIG. 5, i.e., a process executed when the select key F1 or any of the timbre keys T1–T5 is depressed.

First, it is discriminated whether or not "1" is set to the tone bank flag (step U1). If the decision is YES, which means that the tone bank mode has been set by the operation of the tone bank key F2, a process for setting a slave timbre as the second timbre is executed. Then, it is discriminated whether or not the select key F1 is ON (step U2). If the decision is YES, it is then discriminated whether or not the indicator L2 is lit to indicate the back timbre being set (step U3). If the decision in this step is YES, the indicator L1 is turned ON and the indicator L2 is turned OFF, and a timbre number acquired by subtracting 5 from the previously stored timbre number (5–9) is stored in the slave timbre number register (step U4). Consequently, in place of the back timbre, the associated one of the front timbres (0–4) is set as the slave timbre. If the decision in step U3 is NO, the indicator L2 is turned ON and the indicator L1 is turned OFF, and a timbre number acquired by adding 5 to the previously stored timbre number (0–4) is stored in the slave timbre number register (step U5). As a result, the associated one of the back timbres (5–9) is set as the slave timbre in place of the front timbre.

If the decision in step U2 is NO, then it is discriminated whether or not any of the timbre keys T1–T5 is set ON (step U6). If the decision is NO, which means that no alteration of timbre setting is necessary, the flow is completed without execution of any further process. If the decision in step U6 is YES, however, the flow advances to step U7 (timbre setting process) where any one of the timbre numbers (0–9) set by the timbre keys T1–T5 is stored in the slave timbre number register.

The above operational sequence is for setting the slave timbre in accordance with the setting of the tone mix mode, i.e., setting the second timbre (slave timbre) with respect to the first timbre (master timbre).

If the decision in step U1 is NO, which means that the normal mode is presently set, a process for setting the master timbre (first timbre) will mainly be executed. It is discriminated whether or not the select key F1 is ON (step U8). If the decision is YES, it is then discriminated whether or not the indicator L2 is lit to indicate the back timbre being set (step U9). If the decision in this step is YES, the indicator L1 is turned ON and the indicator L2 is turned OFF, and a timbre number acquired by subtracting 5 from the previously stored timbre number (5–9) is stored in the master timbre number register (step U10). If the decision in step U9 is NO, the indicator L2 is turned ON and the indicator L1 is turned OFF, and a timbre number acquired by adding 5 to the previously stored timbre number (0–4) is stored in the master timbre number register (step U11).

If the decision in step U8 is NO, then it is discriminated whether or not any of the timbre keys T1–T5 is set ON (step U12). If the decision is NO, which means that no alteration of timbre setting is necessary, the flow is completed without execution of any further process. If the decision in step U12 is YES, however, the flow advances to step U13 (timbre setting process) where any one of the timbre numbers (0–9) set by the timbre keys T1–T5 is stored in the master timbre number register.

The above operational sequence is for setting the master timbre or the first timbre in accordance with the setting of the normal mode.

A description will now be given of a process for altering only the slave timbre presently set and leaving the presently-set master timbre intact under the condition that the aforementioned tone mix mode is set. This process for altering only the slave timbre is illustrated by the timbre setting flow shown in FIG. 7. In this case, it is first discriminated whether or not "1" is set to the tone bank flag (step U1) and steps U2–U7 are then executed in the aforementioned manner to set a new timbre number corresponding to the slave timbre in the slave timbre number register through the operation of the select key F1 and timbre keys T1–T5.

A description will now be given of a process for altering the master timbre which is presently set under the condition that the tone mix mode is set. This process for altering the master timbre is also illustrated by the timbre setting flow shown in FIG. 7. In this case, the tone bank key F2 is set ON again to temporarily release the tone mix mode and the master timbre is set again in normal mode. In other words, the decision in step U1 in the flow of FIG. 7 is NO, the normal mode is set, and steps U8–U13 are then executed in the aforementioned manner to set a new timbre number is set as the master timbre in the master timbre number register through the operation of the select key F1 and timbre keys T1–T5. Subsequently, the tone bank key F2 is set ON again to set the tone mix mode. To additionally alter the slave timbre, the decision in step U1 is made to be YES as mentioned earlier, and steps U2–U7 are then executed to alter the slave timbre too.

The keying process (step S6) in the general flow shown in FIG. 5 is not specific to this embodiment, and is also executed in the prior art; it is executed when any key on the keyboard 1 is operated. In other words, when the normal mode is set by the operation of the tone bank key F2, a musical tone with one of the timbres selectively set by the operation of the select key F1 and timbre keys T1–T5 is generated from the first sound source 4 alone, and when the tone mix mode is set by the key F2, a musical tone with the master timbre is generated from the first sound source 4 and a musical tone with the slave timbre is generated from the second sound source 5 at the same time.

According to the first embodiment, as described above, a musical tone with one type of timbre (master timbre) selectively set by the operation of the select key F1 and timbre keys T1–T5 is generated in normal mode, and musical tones with two types of timbres (master and slave timbres) selectively set by the select key F1 and timbre keys T1–T5 are generated in tone mix mode to thereby provide a chorus effect with two timbres in unison. Further, since the desired tone waveform is selectively read out from the PCM waveform memory 6, in which different tone waveforms are stored in advance, and is set by the operation of the select key F1 and timbre keys T1–T5, and since the normal mode and tone mix mode can be changed from one to the other even during a musical performance, a player can switch between a musical performance having a chorus effect in tone mix mode and an ordinary musical performance having one timbre in normal mode while easily selecting the desired timbre or timbres. This permits the player to easily carry out a variety of musical performances.

Further, only the slave timbre can be altered in tone mix mode by operating the select key F1 and timbre keys T1–T5.

Furthermore, the master timbre can also be altered in tone mix mode by temporarily releasing this mode, and by setting the mode to the tone mix mode again, a musical performance with the altered master timbre may be carried out again in tone mix mode.

Second Embodiment

Arrangement

A description will now be given of the arrangement of the second embodiment of this invention. The general circuit configuration of the electronic keyboard instrument according to the second embodiment is basically the same as that of the electronic keyboard instrument according to the first embodiment shown in FIG. 1, but differs therefrom in the function keys/function display section 3. Therefore, only the differences will be discussed below.

Figure 8:
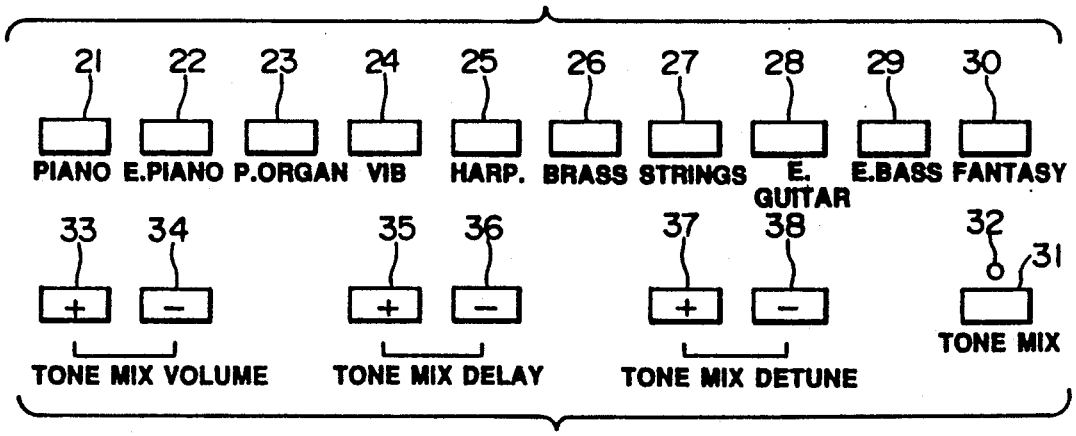

FIG. 8 illustrates the essential section of the function keys/function display section 3 shown in FIG. 1. Timbre select keys 21–30 correspond to the timbre keys T1–T5 in the first embodiment, and these keys, when operated, select data of the timbres of, for example, a piano, electric piano, pipe organ, vibraphone, harp, brass, strings, electric guitar, electric bass and fantasy, respectively.

A tone mix key 31, corresponding to the tone bank key F2 in the first embodiment, is a tone mix mode setting key for generating, in mixed tone, musical tones with two types of timbres selected by the ON operation of the timbre select keys 21–30, i.e., the first tone (master timbre) and the second tone (slave timbre). When this tone mix key 31 is rendered ON, an indicator 32 is turned ON to indicate the tone mix mode being set. In effecting the tone mixing, first, one of the timbre select keys 21–30, for example, key 21, is rendered ON in normal mode, then the tone mix key 31 is rendered ON followed by the ON operation of, for example, the timbre select key 27. Consequently, PIANO and STRINGS are selected as the master timbre and slave timbre, respectively, and tone mixing is executed based on these two timbres.

A tone mix volume+key 33 and a tone mix volume−key 34 serve to change the balance of volumes of the previously-selected master and slave timbres for carrying out the tone mixing of these timbres. These keys 33 and 34 change the volume of a musical tone with that timbre which is selected after the tone mix mode has been set by the operation of the tone mix key 31, i.e., the volume of the musical tone with the slave timbre in the above case. More specifically, when the tone mix+key 33 is rendered ON, the volume of the slave timbre is increased, whereas when the tone mix−key 34 is operated, this volume is decreased, thereby adjusting the balance of the volumes of the master and slave timbres.

A tone mix delay+key 35 and a tone mix delay−key 36 serve to change the attack delay time (tone generation delay time) in the envelope of a musical tone of the previously-selected slave timbre for carrying out the tone mixing of this slave timbre and the previously-selected master timbre.

A tone mix detune+key 37 and a tone mix detune−key 38 serve to change the pitch of a musical tone of the previously-selected slave timbre for carrying out the tone mixing of this slave timbre and the previously-selected master timbre.

FIG. 9 is a diagram for explaining a timbre control register incorporated in the CPU 2; the register comprises a tone mix flag, a master timbre number register and a slave timbre number register. The tone mix flag is "1" when the tone mix mode is set, and it is "0" when this mode is released. When the tone mix mode is released, the master timbre number register serving as the first memory means stores one of timbre numbers (0 to 9) of the timbres selected by the operation of the timbre select keys 21–30. When the tone mix mode is set, the slave timbre number register serving as the second memory means stores one of timbre numbers (0 to 9) of the timbres similarly selected. FIG. 10 illustrates the correlation between these timbre numbers and timbre names.

Operation

Figure 11:
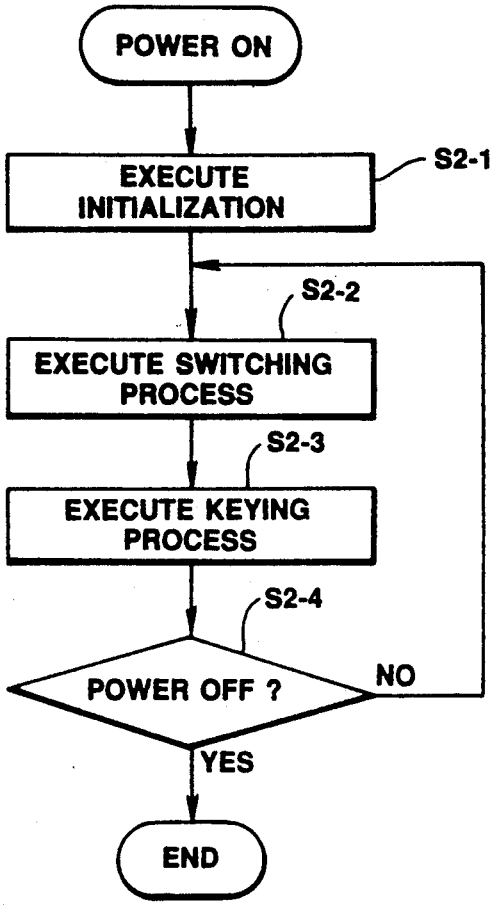

The operation of the second embodiment will now be described. FIG. 11 is a general flowchart for the operation by the CPU 2 which starts when power is supplied to the electronic keyboard instrument according to this embodiment by turning a power switch ON. When the power switch is thrown ON, initialization is executed in which, for example, the tone mix key 31 is set OFF to select the normal mode (step S2-1).

Subsequently, a switching process (step S2-2), which will be described later, will be executed, followed by a keying process (key ON/OFF) to request tone generation/tone off of the first sound source 4 or second sound source 5 (step S2-3). It is then discriminated whether or not the power switch is turned OFF (step S2-4). If the decision here is NO, the flow returns to step S2-2 and the looped sequence including and following this step is repeated until the power switch is turned OFF. If the decision in step S2-4 is YES, however, the flow is completed.

Figure 12:
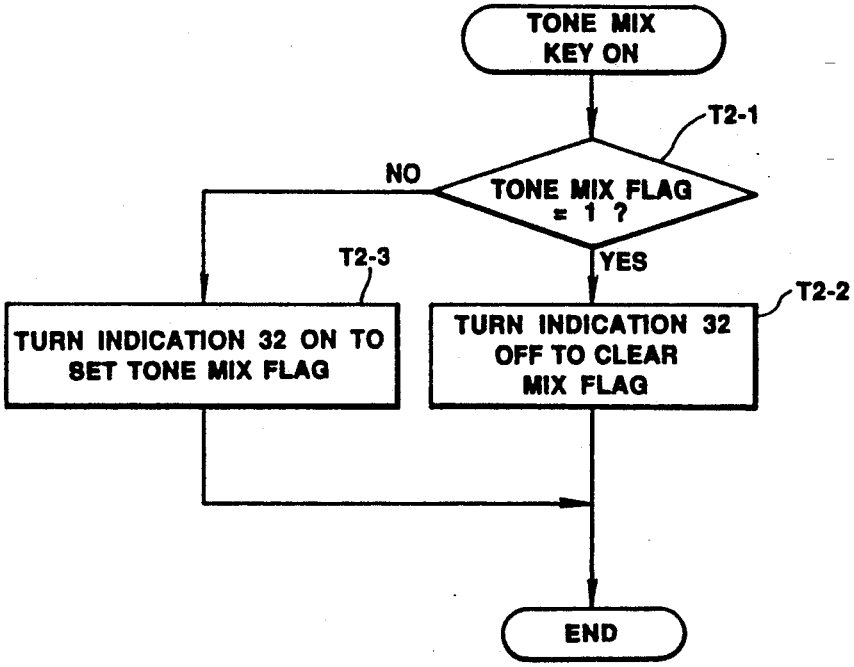

FIG. 12 is a flowchart illustrating the display process of the function display section 3 executed in the switching process (step S2-2) in the general flow shown in FIG. 11. This process starts when the tone mix key 31 is operated.

First, it is discriminated whether or not "1" is set to the tone mix flag (step T2-1). If the decision is YES, it means that the tone mix key 31 has already been operated to set the tone mix mode and the present keying operation releases the tone mix mode. Accordingly, the tone mix flag is cleared and the indicator 32 is turned OFF (step T2-2). When the decision in step T2-1 is NO, it means that the tone mix mode is newly set, and the tone mix flag is set and the indicator 32 is turned ON to indicate the mode being switched to the tone mix mode (step T2-3).

Figure 13:
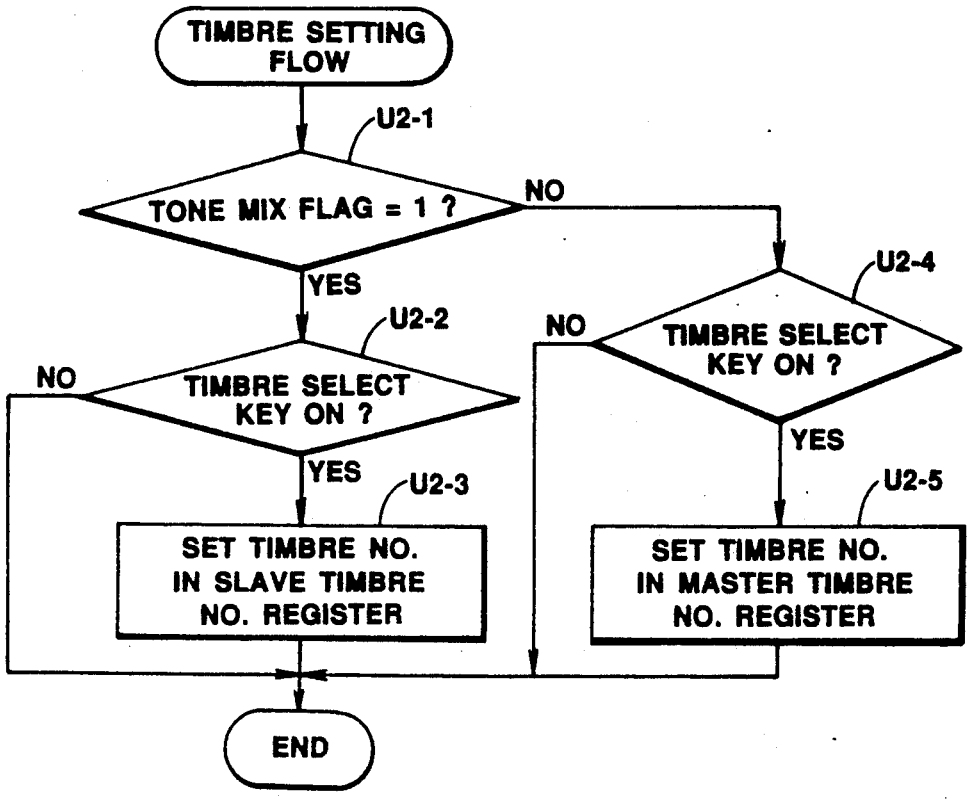

FIG. 13 is a flowchart illustrating the timbre setting process of the function display section 3 executed in the switching process (step S2-2) in the general flow shown in FIG. 11, i.e., the process executed when any of the timbre select keys 21–30 is rendered ON.

First, it is discriminated whether or not "1" is set to the tone mix flag (step U2-1). If the decision is YES, which means that the tone mix mode is set, a process of mainly setting the slave timbre will be executed. It is then discriminated whether or not any of the timbre select keys 21–30 is rendered ON (step U2-2). When the decision in step U2-2 is NO, it means that no alteration of the slave timbre is necessary, and the flow is completed. If the decision in this step is YES, any of the timbre numbers (0–9) specified by the operation of the timbre select keys 21–30 is set in the slave timbre number register (step U2-3).

If the decision in step U2-1 is YES, which means that the normal mode is set, a process of mainly setting the master timbre will be executed. It is then discriminated whether or not any of the timbre select keys 21–30 is rendered ON (step U2-4). If the decision in step U2-4 is NO, it means that no alteration of the master timbre is necessary and the flow is completed. If the decision in this step is YES, any of the timbre numbers (0–9) specified by the operation of the timbre select keys 21–30 is set in the master timbre number register (step U2-5).

Figure 14:
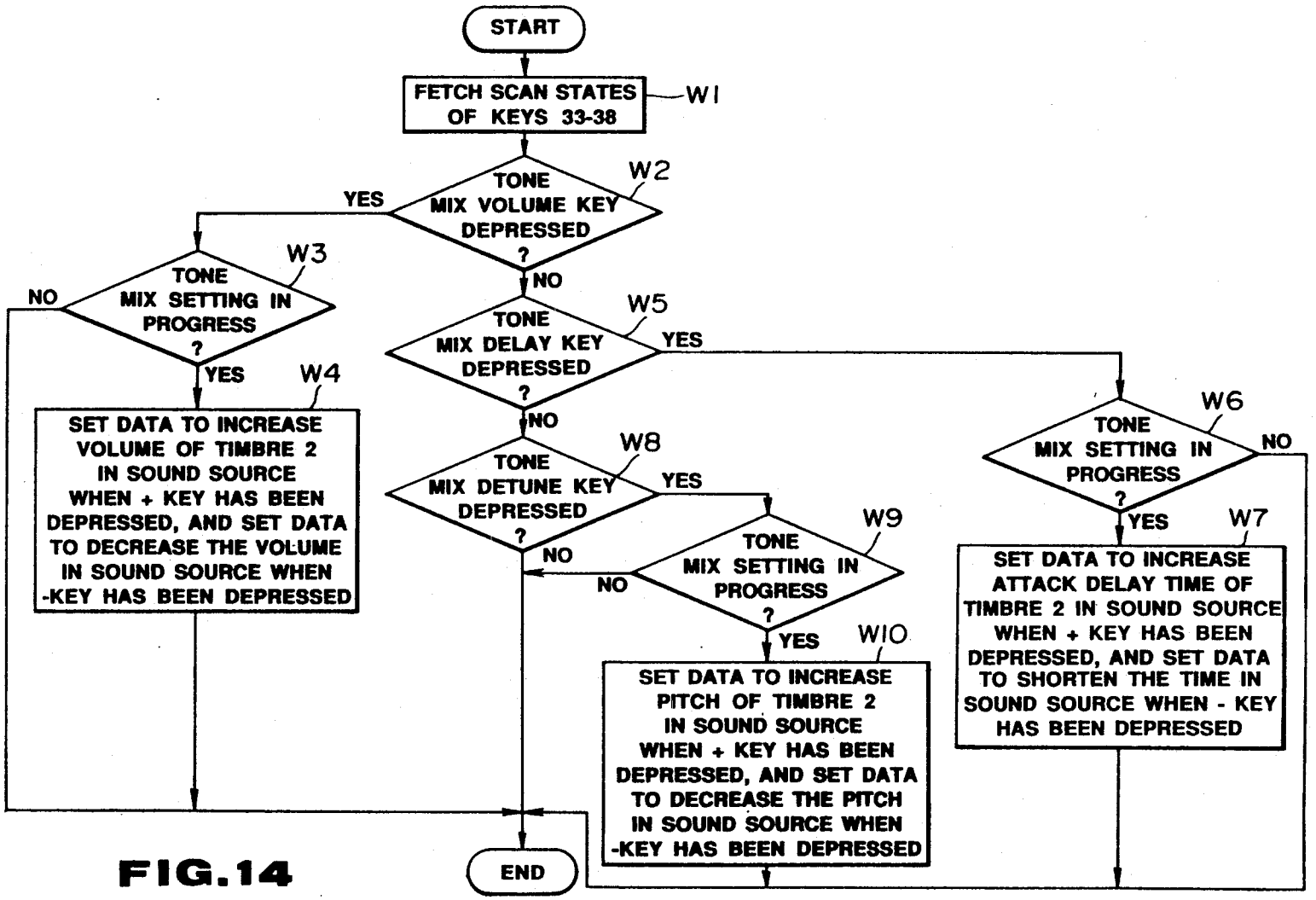

FIG. 14 is a flowchart for a process for variably setting the properties of a musical tone, which is included in the switching process (step S2-2) in the general flow shown in FIG. 11. This process will start when one of the tone mix volume+key 33, tone mix volume−key 34, tone mix delay+key 35, tone mix delay−key 36, tone mix detune+key 37 and tone mix detune−key 37 is rendered ON.

When the flow starts, the ON operational status of the above various keys for variably setting tone parameters are scanned (step W1). It is then discriminated whether or not the operated key is associated with the tone mix volume (step W2). If the decision is YES, it is then discriminated whether or not the tone mix mode is presently set (step W3). If the decision in this step is NO, which means no tone mix mode being presently set, it is unnecessary to alter the tone parameters and the flow will be completed without executing any further process. If the decision in step W3 is YES, the flow advances to step W4 where data to increase the volume of the slave timbre is set in the second sound source 5 (i.e., increasing the level data of each step of an envelope waveform) when the operated key is the tone mix volume+key 33 or data to decrease this volume is set in the second sound source 5 (i.e., decreasing the level data of each step of the envelope waveform) when the tone mix volume−key 34 has been depressed. The flow is then completed.

If the decision in step W2 is NO, it is discriminated whether or nor the operated key is associated with the tone mix delay (step W5). If the decision is YES, it is then discriminated whether or not the tone mix mode is presently set (step W6). If the decision in this step is NO, it is unnecessary to alter the tone parameters and the flow will be completed without executing any further process. If the decision in step W6 is YES, the flow advances to step W7 where data to increase the attack delay time of the slave timbre is set in the second sound source 5 when the operated key is the tone mix delay+-key 35 or data to decrease this attack delay time is set in the second sound source 5 when the tone mix delay−-key 36 has been depressed, thereby adjusting the attack delay time of the slave timbre with respect to that of the master timbre. The flow is then completed.

If the decision in step W5 is NO, it is discriminated whether or not the operated key is associated with the tone mix detune (step W8). If the decision is NO, it is unnecessary to alter an tone parameter and the flow will be completed without executing any further process. If the decision in step W8 is YES, however, it is then discriminated whether or not the tone mix mode is presently set (step W9). If the decision in this step is NO, it is unnecessary to provide a detune effect to a musical tone and the flow will be completed without executing any further process. If the decision in step W9 is YES, the flow advances to step W10 where data to increase the pitch of the slave timbre is set in the second sound source 5 when the operated key is the tone mix detune+key 37 or data to decrease this pitch is set in the second sound source 5 when the tone mix detune−-key 38 has been depressed, thereby adjusting the detune effect between the slave and master timbres. The flow is then completed.

According to the second embodiment, the process for altering only the slave timbre and the process for altering the master timbre in tone mix mode are executed in the same manner as per the first embodiment; their description will therefore be omitted.

According to the second embodiment, as described above, a musical performance with one type of timbre (master timbre) selectively set by the operation of the timbre select keys 21–30 is generated in normal mode, and musical tones with two types of timbres, this master timbre and another type of timbre (slave timbre) selectively set by the timbre select keys 21–30, are mixed in tone mix mode to provide a musical performance having a chorus effect with these two timbres in unison. Further, in tone mix mode, variable setting of the tone parameters of the slave timbre balances the volumes of the slave and master timbres, gives a variation in timbre due to the difference in attack delay time or causes a difference in pitch between the slave and master timbres. This can permit the player to carry out a musical performance with a wider variety of tones in tone mix mode.

Modifications

Although in the above embodiments, the first and second sound sources 4 and 5 are separately provided to generate tone signals with difference timbres, it is possible to use a single sound source which is designed to simultaneously generate tone signals with different timbres in a time-shared multiplex process.

Further, according to the above embodiments, stereo signals of the first timbre of two (right and left) channels, generated from the first sound source 4, are mixed with stereo signals of the second timbre of two channels, similarly generated from the second sound source 5, in the left channel mixer 7 and right channel mixer 8, respectively, and the resultant signals are generated in stereo as two-channel musical tones with two types of timbres mixed. However, the instrument may be designed in such a way that the musical tone with the first timbre generated from the first sound source 4 and the musical tone with the second timbre generated from the second sound source 5 are not mixed with each other, but are generated through the respective right and left channels as separate musical tones, the former tone being output from the right channel speaker 12 via the right channel amplifier 11 and the latter being output from the left channel speaker 10 via the left channel amplifier 9. The separate musical tones may be generated through the left and right channels instead of right and left. In this case, the former tone is output from the left channel speaker 10 via the left channel amplifier 9, while the latter tone is output from the right channel speaker 12 via the right channel amplifier 11. In either case, although musical tones with two type of timbres are mixed in the electronic musical instrument, the simultaneously generated musical tones may be heard mixed to produce a tone mix effect.

Although the above embodiments are directed to an electronic keyboard instrument, this invention can be applied to other electronic musical instruments such as an electronic string instrument and electronic wind instrument by modifying the structure of play input detecting means for detecting performance data.

Although according to the second embodiment, three types of tone parameters for the slave timbre can be variably set, the parameters are not limited to three types; the parameters for the master timbre or both the master and slave timbres may be variably set.

What is claimed is:

1. A timbre setting device for an electronic musical instrument for setting a tone signal of a first-and-second-timbre mixed type, said timbre setting device comprising:

timbre designating means for sequentially designating a plurality of timbre data, each said timbre designating a tone of a note to be generated;

first memory means for storing timbre data of said first timbre;

second memory means for storing timbre data of said second timbre: and timbre setting control means for causing at least one of said first memory means and said second memory means to store the last of said plurality of timbre data designated by said timbre designating means.

2. An electronic musical instrument for generating a tone signal with a first timbre in a normal mode, and a tone signal with first timbre and a second timbre in a tone mix mode, said instrument comprising:

mode selecting means for selectively setting one of said normal mode and said tone mix mode;

timbre designating means for sequentially designating a plurality of timbre data, each said timbre designating a tone of a note to be generated;

first memory means for storing first timbre data of said first timbre;

second memory means for storing second timbre data of said second timbre;

timbre setting control means for causing at least one of said first memory means and said second memory means to store the last of said plurality of timbre data designated by said timbre designating means; and tone signal generating means for generating a tone signal according to the first timbre data in said first memory means when said normal mode is set by said mode selecting means and for generating a tone signal according to both said first timbre data in said first memory means and said second timbre data in said second memory means when said tone mix mode is set by said mode selecting means.

3. The electronic musical instrument according to claim 2, wherein said timbre setting control means responsive to said mode selecting means setting said tone mix mode for altering said timbre data of at least one of said first timbre data stored in said first memory means and said second timbre data stored in said second memory means.

4. The electronic musical instrument according to claim 2, further comprising tone parameter setting means for variably setting a parameter of at least one of a musical tone with said first timbre based on said first timbre data and a musical tone with said second timbre based on said second timbre data.

5. The electronic musical instrument according to claim 4, wherein said tone parameter setting means comprises mean for setting a tone volume as a parameter.

6. The electronic musical instrument according to claim 4, wherein said tone parameter setting means comprises means for setting an attack delay time as a parameter.

7. The electronic musical instrument according to claim 4, wherein said tone parameter setting means comprises means for setting a tone pitch as a parameter.

8. A timbre setting device for an electronic musical instrument capable of generating a tone signal with a first timbre in a normal mode and a tone signal with first timbre and a second timbre in a tone mix mode, said device comprising:

timbre designating means for sequentially designating a plurality of timbre data, each said timbre designating a tone of a note to be generated;

first memory means for storing first timbre data of said first timbre;

second memory means for storing second timbre data of said second timbre; and timbre setting control means for causing at least one of said first memory means and said second memory means to store the last of said plurality of timbre data designated by said timbre designating means.

9. The timbre setting device according to claim 8, further comprising tone parameter setting means for variably setting a parameter of at least one of a musical tone with said first timbre based on said first timbre data and a musical tone with said second timbre based on said second timbre data.

10. The timbre setting device according to claim 8, wherein said tone parameter setting means comprises means for setting a tone volume as a parameter.

11. The timbre setting device according to claim 8, wherein said tone parameter setting means comprises means for setting an attack delay time as a parameter.

12. The timbre setting device according to claim 8, wherein said tone parameter setting means comprises means for setting a tone pitch as a parameter.

* * * * *